US006533540B1

(12) United States Patent
Mathis

(10) Patent No.: US 6,533,540 B1
(45) Date of Patent: Mar. 18, 2003

(54) DOUBLE-SEAL/OIL-RESERVOIR SYSTEM FOR A MOTOR/PUMP ASSEMBLY

(75) Inventor: Cleo D. Mathis, San Clemente, CA (US)

(73) Assignee: Sta-Rite Industries, Inc., Delavan, WI (US)

( * ) Notice: Subject to any disclaimer, the term of this patent is extended or adjusted under 35 U.S.C. 154(b) by 0 days.

(21) Appl. No.: 09/875,927

(22) Filed: Jun. 8, 2001

Related U.S. Application Data

(60) Provisional application No. 60/210,456, filed on Jun. 9, 2000.

(51) Int. Cl.[7] ..... F04D 29/12

(52) U.S. Cl. ..... 415/109; 415/112; 415/174.3; 415/231

(58) Field of Search ..... 415/111, 112, 415/109, 206, 214.1, 231, 230, 174.3; 277/366, 367, 368, 369, 379, 390, 401, 404, 405

(56) References Cited

U.S. PATENT DOCUMENTS

| | | | | | |
|---|---|---|---|---|---|
| 2,133,304 | A | * | 10/1938 | Nichols | 277/366 |
| 2,418,194 | A | * | 4/1947 | Piccardo | 277/366 |
| 3,301,191 | A | * | 1/1967 | Warren | 277/366 |
| 3,361,431 | A | * | 1/1968 | Liss et al. | 277/366 |
| 3,741,679 | A | * | 6/1973 | Johnston | 415/170 |
| 5,490,679 | A | * | 2/1996 | Borrino et al. | 277/369 |

* cited by examiner

*Primary Examiner*—Ninh Nguyen

(57) ABSTRACT

A double-seal/oil-reservoir system for motor/pump assembly includes first seal (S1) and a second seal (S2) of a carbon/ceramic ring type that are axially spaced from one another along a drive shaft (24). A containment volume "V" is defined between the first and second seals (S1 and S2) in which an oil or oil-like fluid is contained to prevent seepage or weepage of the fluid circulated by the pump.

4 Claims, 4 Drawing Sheets

DOUBLE-SEAL/OIL-RESERVOIR SYSTEM FOR A MOTOR/PUMP ASSEMBLY

This application claims the benefit of Ser. No. 60/210,456, filed Jun. 9, 2000.

BACKGROUND OF THE INVENTION

The present invention relates to a double-seal/oil-reservoir system for a motor/pump assembly for sealing the drive shaft of a shaft-driven pump from undesired leakage, and, more particularly, shaft-sealing arrangements for sealing the drive shafts of pumps used in whirlpool tub and spa installations.

Whirlpool bath and spa-type installations typically include a tub structure having a plurality of water jets for introducing a pressurized stream of water and air into the tub and a suction inlet from which water is withdrawn. The water withdrawn from the tub through the suction inlet is provided to a shaft-driven recirculation pump which pressurizes the water and distributes the pressurized water to the water jets for re-introduction into the tub.

The recirculation pump typically includes a motor driving an impeller-type centrifugal pump through a connecting drive shaft. The impeller is rotated about an axis in a pump housing that includes an inlet side and an outlet side separated by an internal partition that defines a scroll-like impeller chamber. Water drawn into the inlet side of the impeller chamber is pressurized by the rotating impeller and forced to and through the outlet.

The motor shaft typically passes through an end housing of the pump and is supported for rotation by a journal-type bearing. In general, the journal bearing is adequate to provide a long, trouble-free operating life while also providing reasonably effective control of leakage from the interior of the pump to the exterior via the clearance between the outside diameter of the shaft and the inside diameter of its journal bearing. While the shaft/journal system is effective to control leakage, some of the water passing through the pump will "weep" to the exterior of the pump. The weepage rate can vary between, for example, 1-drop/hour to 1-drop/minute of operation of the pump.

The user of the whirlpool tub or spa will commonly use various soaps, detergents, body lotions, and the like that go into solution in the circulating water. Additionally, is not uncommon to pre-treat the water with various materials including anti-bacterial, anti-fungal, pH-control chemicals, colorants, ozone, bromine and/or chlorine-release chemicals that also go into solution in the circulating water. The nature of some of these solutes is such that they can aggressively degrade a shaft seal. As a consequence, the weepage about the drive shaft, when it evaporates, will deposit various solids from the water solution, and, additionally, chemical activity can degrade the seal-function until the pump must be replaced or otherwise serviced. In practice, seal integrity is one of the primary factors limiting the operational life of motor/pump assemblies in the spa and whirlpool tub market.

SUMMARY OF THE INVENTION

In view of the above, it is an object of the present invention, among others, to provide an effective and low-cost double-seal/oil-reservoir system for a motor/pump assembly as a solution to the seal-integrity problem associated with shaft-driven pumps, particularly in whirlpool tub and spa installations.

In view of these objects, and others, the present invention provides a double-seal/oil-reservoir system for use in pumps used in the whirlpool tub and spa industry. The system includes first and second mechanical seals spaced apart on the operating shaft to define a volume or space therebetween that contains a volume of oil or oil-like fluid. The oil or oil-like fluid assists in maintaining the integrity of the first and the second seals while greatly limiting the opportunity for any leakage or seepage of the circulating water. In the preferred embodiment, the first and second seals are annular carbon ring/ceramic ring axial face seals. The carbon ring includes an axial face that is resiliently biased against a cooperating axial face of the ceramic seal to form a fluid-tight seal therebetween. While cooperating carbon/ceramic axial-face seals are preferred, conventional elastomeric 'lip' seals can also function as either and/or the first and second seals.

The combination of the first and the second seals axially spaced on the operating shaft and the intermediate volume or chamber containing an oil or oil-like fluid greatly reduces the probability of leakage to the exterior of the pump housing and increases the operating life of the motor/pump assembly.

The present invention advantageously provides a double-seal/oil-reservoir system for containing seepage from the pump that solves the prior seal integrity problem.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
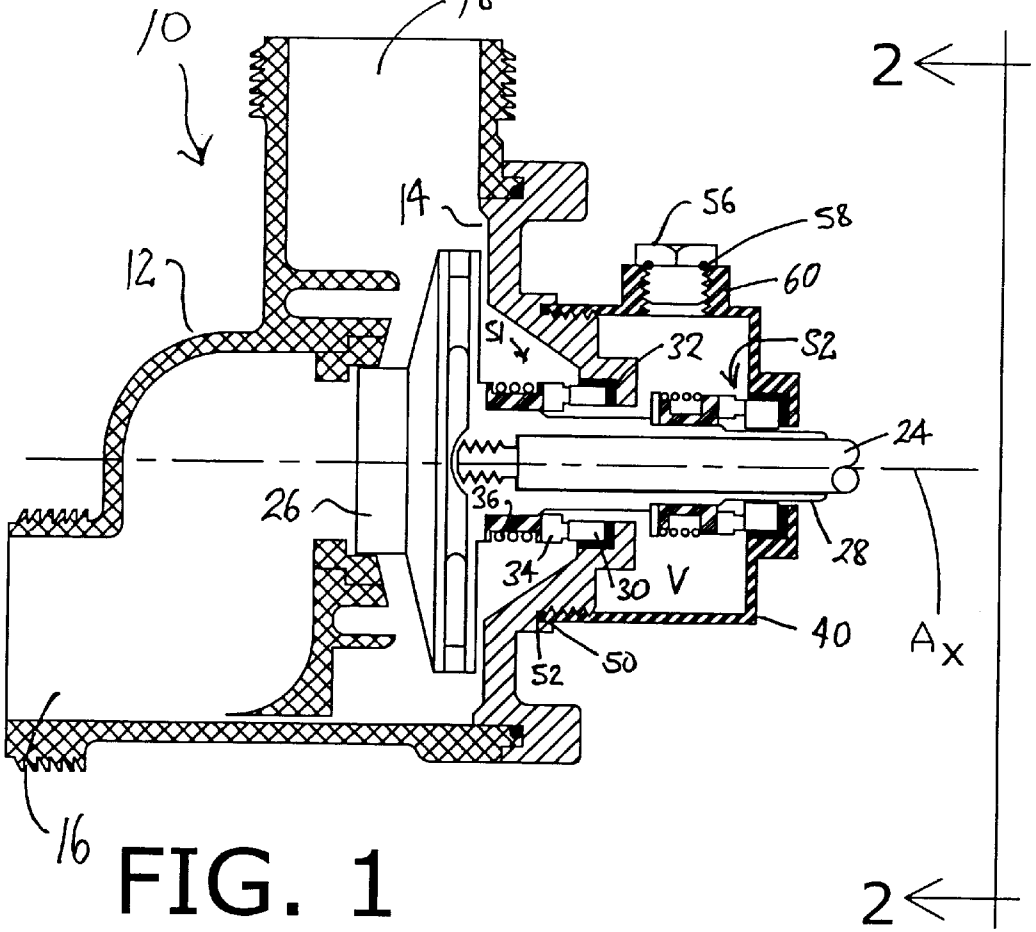
FIG. 1 is a side elevational view, in cross section, of an exemplary pump assembly having first and second axially spaced seals with an intermediate volume containing an oil or oil-like fluid.

A double-seal/oil-reservoir system for motor/pump assembly in accordance with the present invention is shown in FIG. 1 with an exemplary pump 10. As shown, the pump 10 is typically formed as a two-piece assembly including an impeller housing 12 that is secured by threaded fasteners (not shown) to a complementary end housing 14. A pump inlet 16 for receiving a flow of water and a pump outlet 18 through which pressurized water is output from the pump 10 are formed as part of the impeller housing 12. Both the impeller housing 12 and the end housing 14 are preferably molded from a fiber-reinforced plastic. The end housing 14 includes a circumferential groove 20 that retains a O-ring 22.

The groove 20 and the O-ring 22 interface with the impeller housing 12 to form a watertight sealment. The end housing 14 includes a central opening (unnumbered) through which the motor drive shaft 24 extends; the drive shaft 24 rotates about an axis $A_x$. An impeller 26 is secured (by threaded engagement) to the end of the shaft 24 for rotation therewith and is designed to pressurize water entering the inlet 16 for discharge through the outlet 18. The impeller 26 includes an integrally formed sleeve 28 that fits over the motor shaft 24.

The double-seal/oil-reservoir system of the present invention includes a first carbon/ceramic face seal, generally indicated at Si and a second axially spaced carbon/ceramic face seal, generally indicated at S2.

The first carbon/ceramic seal S1 includes an annular ceramic ring 30 that surrounds the shaft 24 and which is mounted or carried in a annular elastomer 'boot' 32, typically VITON. The elastomer boot 32 is carried in an appropriately sized counterbore (unnumbered) formed in the end housing 14. The elastomer boot 32 defines a resilient mounting for the ceramic ring 30. A carbonaceous sealing ring 34 is mounted on the shaft 24 for rotation therewith and is resiliently urged toward and against the ceramic ring 30 by a helical coil spring 36 in compression. A spring shield 38 is interposed between the end of the coil spring 36 and the carbon ring 34. The carbon ring 34 includes a polished axial face (unnumbered) that faces and is in sealing contact with a polished axial face (unnumbered) of the ceramic ring 30.

A cup-like containment 40 is mounted on a cylindrical boss-like formation 48 on the exterior of the end housing 14; preferably with a fluidtight threaded engagement 50 that includes an O-ring 52. The containment 40 includes a central opening 54 through which the drive shaft 24 extends. The axial depth of the containment 40 is such that a containment volume 'V' is defined between the interior surfaces of the containment 40 and the external end of the boss 48.

The second carbon/ceramic seal S1 is mounted in the rear extent of the cup-like containment 40; the second carbon/ceramic seal S1, like the first carbon/ceramic seal S1, includes an annular ceramic ring 30 that surrounds the shaft 24 and which is also mounted or carried in a annular elastomer 'boot' 32 that is carried in an appropriately sized counterbore formed in the rear end of the containment 40. A carbonaceous sealing ring 34 is mounted on the shaft 24 for rotation therewith and is resiliently urged toward and against the ceramic ring 30 by a helical coil spring 36 in compression. A spring shield 38 is interposed between the end of the coil spring 36 and the carbon ring 34. The carbon ring 34 includes a polished axial face (unnumbered) that faces and is in sealing contact with a polished axial face (unnumbered) of the ceramic ring 30.

During normal operation, the interfacing surfaces of carbon and ceramic rings of the first and second seals, S1 and S2, move relative to one another as the shaft 24 rotates about the axis $A_x$ to provide a long-lasting and fluid-tight seal.

The containment 40 includes a threaded fill-plug 56 (with O-ring 58) that engages an appropriately sized and threaded fill-port 60 and through which an oil or oil-like fluid is introduced into the volume 'V'.

The oil or oil-like fluid can include petroleum-based oils of various viscosities and/or silicone-based and or teflon-based fluids. While a liquid material is preferred, the viscosity of the oil or oil-like fluid can approach that of a conventional grease. The fluid that is contained within the containment volume "V" is preferably of the type that does not mix, admix, or go into solution or suspension with water and is preferably hydrophobic.

In operation, any water seepage or weepage through the first seal S1 encounters the oil or oil-like fluid in volume "V"; the so-encountered oil or oil-like fluid acting as a barrier to further leakage of that water through the second seal S2.

Figure 2:
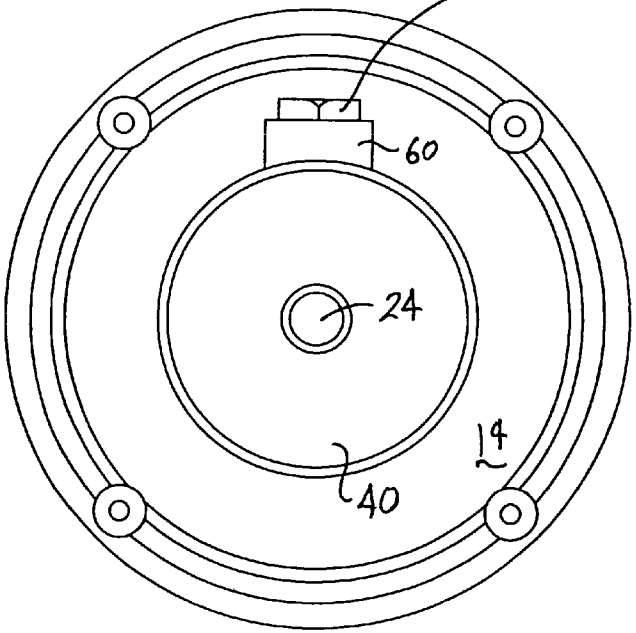
FIG. 2 is a end view of the pump of FIG. 1 taken along line 2—2 of FIG. 1.
Figure 4:
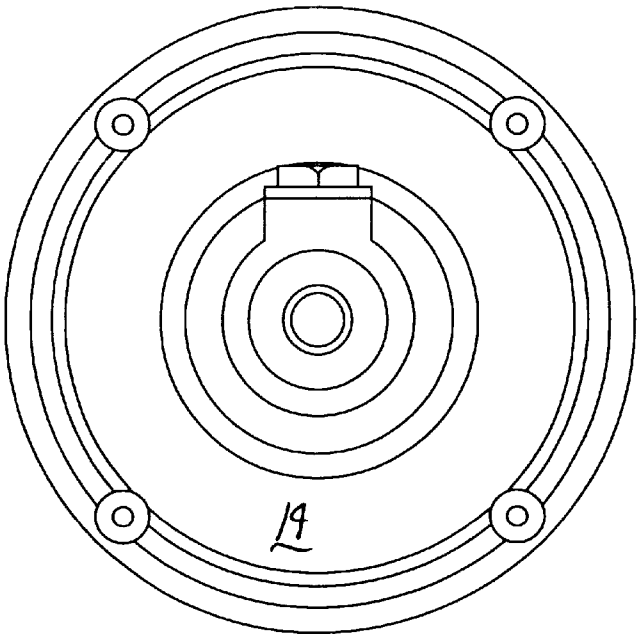
FIG. 4 is a end view of the pump of FIG. 1 taken along line 4—4 of FIG. 3.
Figure 3:
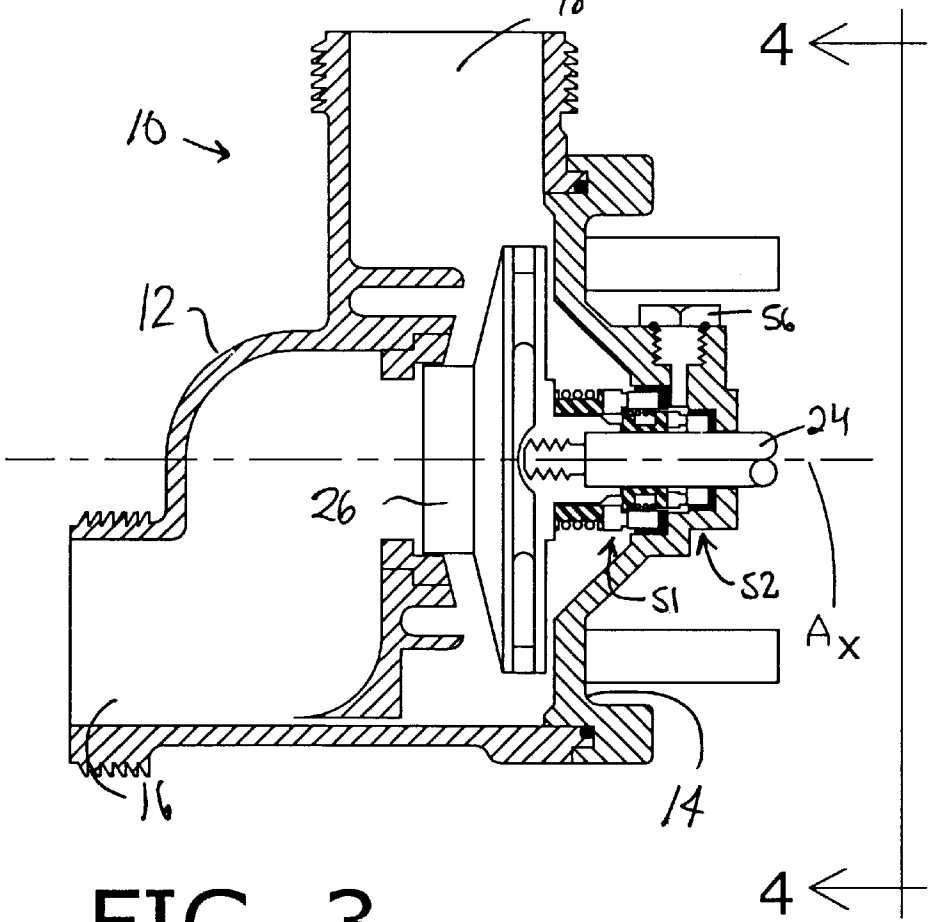
FIG. 3 is a side elevational view, in cross section, of a portion of a pump housing showing another embodiment of the first and second axially spaced seals with an intermediate volume containing an oil or oil-like fluid.

A second embodiment of the present invention is shown in FIGS. 3 and 4 and is designed so that the containment and the first and the second seals, S1 and S2, are integrally molded into the end plate 14 in contrast to the screw-on cup-like containment 40 that defines the volume "V" of the first embodiment of FIGS. 1 and 2.

Figure 5:
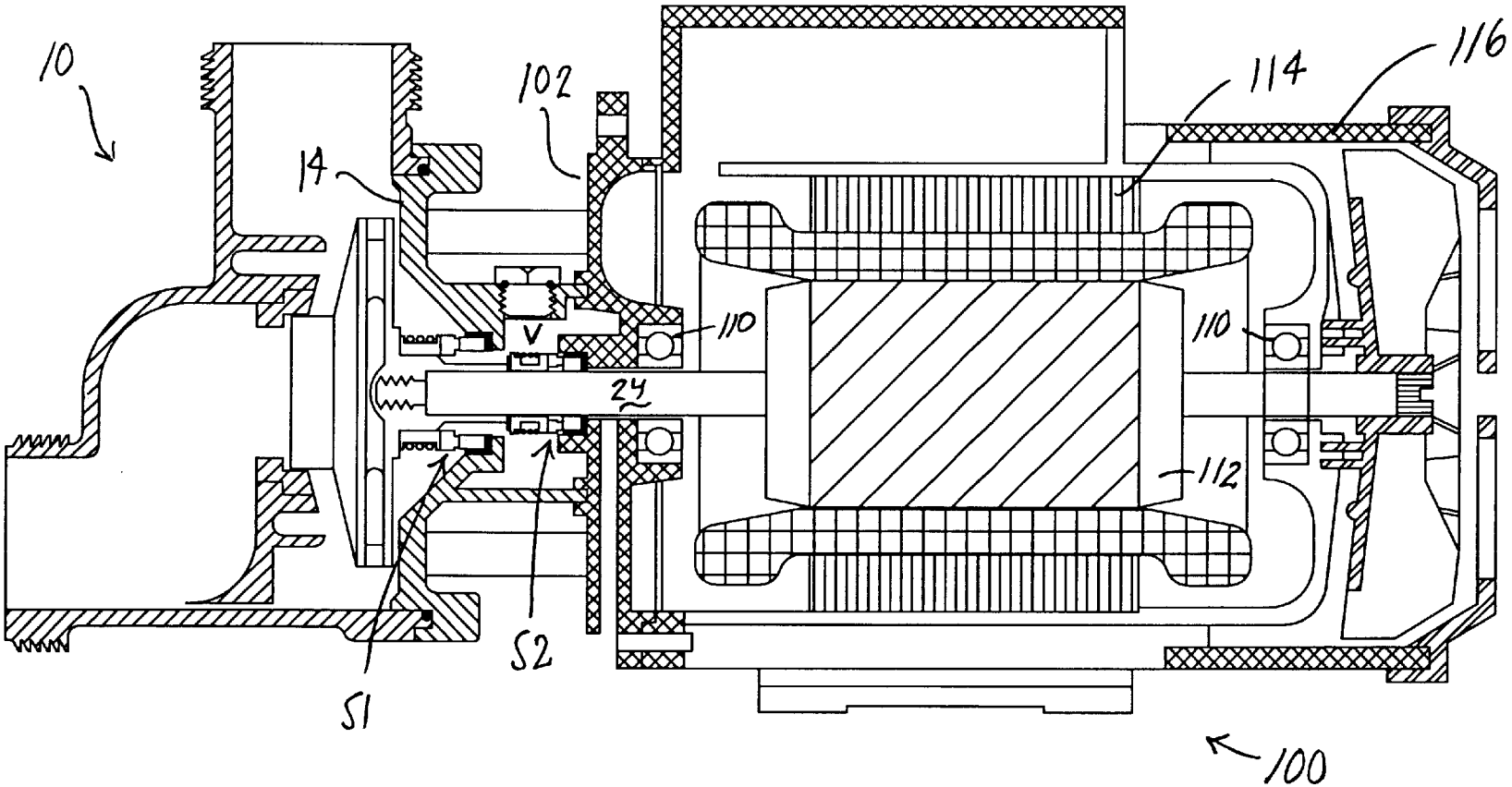
FIG. 5 is a side elevational view, in cross section, of an electric motor that drives a connected circulating pump and showing another embodiment of the first and second axially spaced seals with an intermediate volume containing an oil or oil-like fluid.
Figure 6:
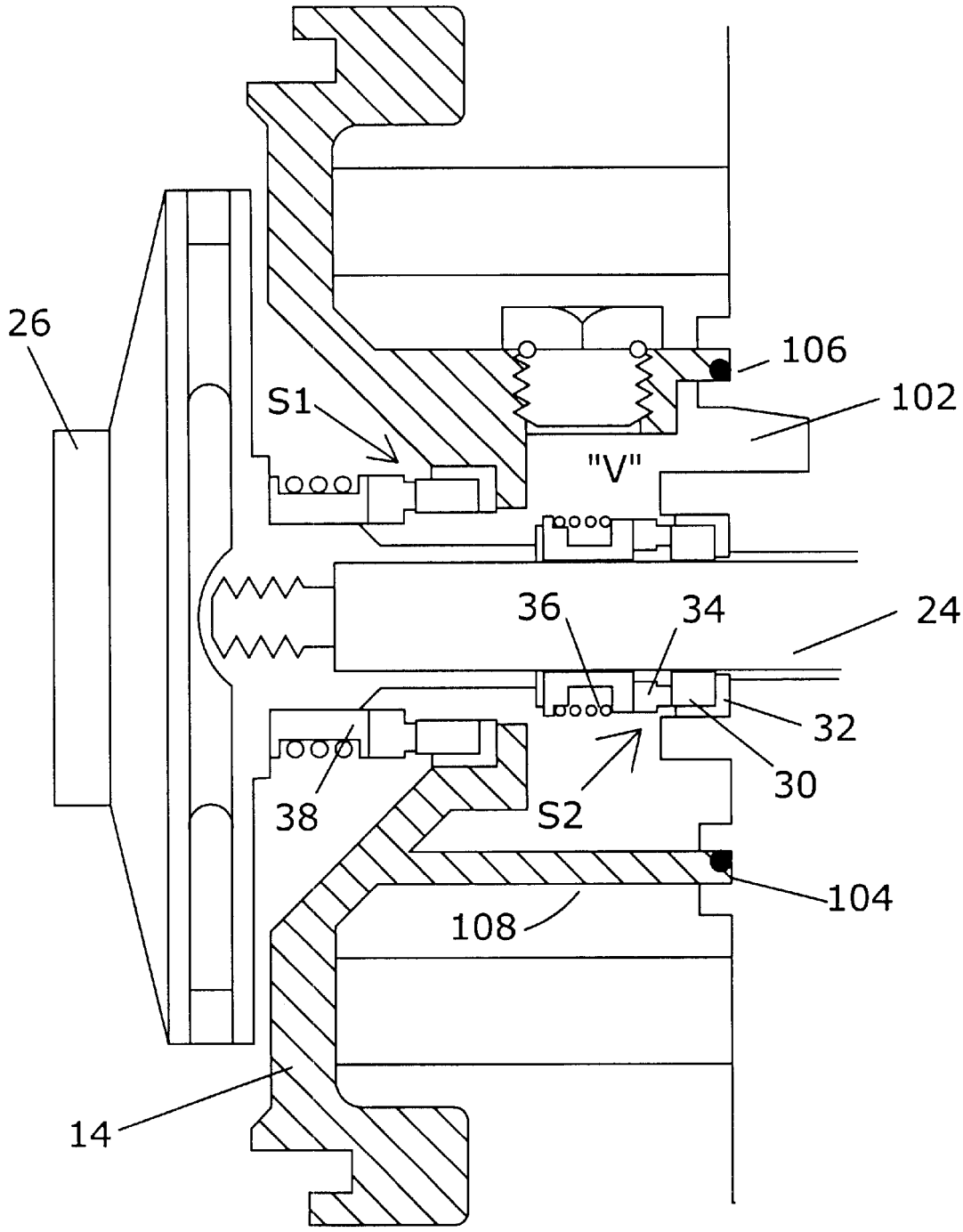
FIG. 6 is an enlarged view of a portion of FIG. 5 showing the details of the shaft seal arrangement.

A third embodiment of the present invention is shown in FIGS. 5 and 6 in which the pump 10 is shown in its assembled relationship with its drive motor 100 and the first and second seals, S1 and S2, are mounted, respectively, in the end plate 14 of the pump 10 and the frontplate 102 of the motor 100. As shown in the enlarged detail of FIG. 6, the first seal S1 is mounted in the end plate 14 of the pump 10 in a manner similar to that described above. The second seal S2, however, is carried in an appropriately sized counterbore (unnumbered) in the frontplate 102 of the motor 100. The frontplate 102 of the motor 100 includes a circumferential groove 104 and O-ring 106 that receives a rearwardly extending cylindrical extension 108 of the end plate 14 of the pump 10 to define the containment volume "V" when the pump 10 and its motor 100 are assembled together.

The drive motor 100 is of the induction-type and, as shown in FIG. 5, includes bearings 110 upon which the drive shaft 24 is mounted, a rotor 112 carried on the drive shaft 24 for rotation therewith, and a stator 114 carried in a motor housing 116.

As will be apparent to those skilled in the art, various changes and modifications may be made to the illustrated double-seal/oil-reservoir system for motor/pump assembly of the present invention without departing from the spirit and scope of the invention as determined in the appended claims and their legal equivalent.

What is claimed is:

1. A multi-seal shaft-sealing system for sealing the shaft-drive connection between a shaft-driven pump and driving motor, comprising:

a first seal mounted in a body wall of the pump for effecting a sealing relationship with a rotatable drive shaft extending therethrough, the body wall of the pump having a boss thereon, said boss having threads thereon, a containment cup mountable in sealing engagement with the body wall of the pump and having a second seal axially spaced from the first seal on the drive shaft, the containment cup defining a containment volume between said first and second seals, said containment cup having a portion thereof with threads thereon complementary to the threads on said boss for effecting threaded engagement thereon to connect the containment cup to the body wall of the pump and thereby define the containment volume, and an oil or oil-like fluid in the containment volume to minimize weepage through the seals and the containment volume.

2. The multi-seal shaft-sealing system of claim 1, wherein both said first and second seals are of the carbonaceous ring/ceramic ring type.

3. A multi-seal shaft-sealing system for sealing the shaft-drive connection between a shaft-driven pump and an driving motor, comprising:

a first seal mounted in a body wall of the pump for effecting a sealing relationship with a rotatable drive shaft extending therethrough, an extension extending from the body wall of the pump and surrounding the first seal; and a second seal mounted in a body wall of the motor for effecting a sealing relationship with the rotatable drive shaft extending therethrough, the body wall of the motor having a surface for receiving the extension when the pump and motor are mounted together to define a containment volume for receiving an oil or oil-like fluid in the containment volume to minimize weepage through the seals and the containment volume.

4. The multi-seal shaft-sealing system of claim 3, wherein both said first and second seals are of the carbonaceous ring/ceramic ring type.

* * * * *